US007318843B2

(12) United States Patent
Sivik et al.

(10) Patent No.: US 7,318,843 B2
(45) Date of Patent: Jan. 15, 2008

(54) FABRIC CARE COMPOSITION AND METHOD FOR USING SAME

(75) Inventors: Mark Robert Sivik, Mason, OH (US); Jeffrey Scott Dupont, Cincinnati, OH (US); Victor Manuel Arredondo, West Chester, OH (US); Richard Timothy Hartshorn, Lawrenceburg, IN (US); Robb Richard Gardner, Cincinnati, OH (US); William Michael Scheper, Guilford, IN (US); John Christian Haught, West Chester, OH (US); Jeffrey John Scheibel, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 283 days.

(21) Appl. No.: 10/876,180

(22) Filed: Jun. 24, 2004

(65) Prior Publication Data

US 2005/0003981 A1 Jan. 6, 2005

Related U.S. Application Data

(60) Provisional application No. 60/483,343, filed on Jun. 27, 2003.

(51) Int. Cl.
*C11D 7/50* (2006.01)

(52) U.S. Cl. ..... 8/142; 8/137; 510/276

(58) Field of Classification Search ..... None
See application file for complete search history.

(56) References Cited

U.S. PATENT DOCUMENTS

| | | | | |
|---|---|---|---|---|
| 2,787,596 | A | 4/1957 | Stewart et al. | |
| 3,370,330 | A | 2/1968 | Sieber | |
| 3,658,575 | A | 4/1972 | Tabor et al. | |
| 3,771,955 | A | 11/1973 | Jones | |
| 3,784,355 | A | 1/1974 | Fielding | |
| 3,953,381 | A | 4/1976 | Remond et al. | |
| 4,097,397 | A | 6/1978 | Mizutani et al. | |
| 4,102,824 | A | 7/1978 | Mizutani et al. | |
| 4,124,517 | A | 11/1978 | Hisamoto | |
| 4,639,321 | A | 1/1987 | Barrat et al. | |
| 4,685,930 | A | 8/1987 | Kasprzak et al. | |
| 4,708,807 | A | 11/1987 | Kemerer et al. | |
| 4,911,853 | A | 3/1990 | Coffindaffer et al. | |
| 5,057,240 | A | 10/1991 | Madore et al. | |
| 5,133,897 | A | 7/1992 | Balzer | |
| 5,705,562 | A | 1/1998 | Hill et al. | |
| 5,707,613 | A | 1/1998 | Hill et al. | |
| 5,865,851 | A | 2/1999 | Sidoti et al. | |
| 5,865,852 | A | 2/1999 | Berndt et al. | |
| 5,876,510 | A | 3/1999 | Kuemin et al. | |
| 5,888,250 | A | 3/1999 | Hayday et al. | |
| 5,942,007 | A | 8/1999 | Berndt et al. | |
| 5,977,040 | A | 11/1999 | Inada et al. | |
| 5,985,810 | A | 11/1999 | Inada et al. | |
| 6,013,682 | A | 1/2000 | Dalle et al. | |
| 6,013,683 | A | 1/2000 | Hill et al. | |
| 6,042,617 | A | 3/2000 | Berndt et al. | |
| 6,042,618 | A | 3/2000 | Berndt et al. | |
| 6,056,789 | A | 5/2000 | Berndt et al. | |
| 6,059,845 | A | 5/2000 | Berndt et al. | |
| 6,060,546 | A | 5/2000 | Powell et al. | |
| 6,063,135 | A | 5/2000 | Berndt et al. | |
| 6,083,901 | A | 7/2000 | Perry et al. | |
| 6,106,818 | A * | 8/2000 | Dulog et al. | 424/78.03 |
| 6,114,298 | A | 9/2000 | Petri et al. | |
| 6,136,766 | A | 10/2000 | Inada et al. | |
| 6,136,778 | A | 10/2000 | Kamiya | |
| 6,156,074 | A | 12/2000 | Hayday et al. | |
| 6,177,399 | B1 | 1/2001 | Mei et al. | |
| 6,200,943 | B1 | 3/2001 | Romack et al. | |
| 6,258,130 | B1 | 7/2001 | Murphy et al. | |
| 6,273,919 | B1 | 8/2001 | Hayday et al. | |
| 6,309,425 | B1 | 10/2001 | Murphy et al. | |
| 6,310,029 | B1 * | 10/2001 | Kilgour et al. | 510/466 |
| 6,312,476 | B1 | 11/2001 | Perry et al. | |
| 6,313,079 | B1 | 11/2001 | Murphy | |
| 6,368,359 | B1 | 4/2002 | Perry et al. | |
| 6,521,580 | B2 | 2/2003 | Perry et al. | |
| 6,548,465 | B2 | 4/2003 | Perry et al. | |
| 6,610,108 | B2 | 8/2003 | Perry et al. | |
| 6,673,764 | B2 | 1/2004 | Severns et al. | |
| 6,706,076 | B2 | 3/2004 | Deak et al. | |
| 6,706,677 | B2 | 3/2004 | Burns | |
| 6,890,892 | B2 * | 5/2005 | Scheper et al. | 510/285 |
| 6,914,040 | B2 * | 7/2005 | Deak et al. | 510/285 |
| 6,939,837 | B2 * | 9/2005 | Noyes et al. | 510/285 |
| 2002/0004953 | A1 | 1/2002 | Perry et al. | |
| 2002/0007519 | A1 | 1/2002 | Noyes et al. | |
| 2002/0133885 | A1 | 9/2002 | Noyes et al. | |
| 2003/0060396 | A1 * | 3/2003 | Deak et al. | 510/511 |

(Continued)

FOREIGN PATENT DOCUMENTS

| | | |
|---|---|---|
| DE | 1 496 248 | 2/1970 |

(Continued)

*Primary Examiner*—Gregory Webb
(74) *Attorney, Agent, or Firm*—Kim William Zerby; Steven W. Miller

(57) ABSTRACT

Compositions for treating fabric articles comprising novel detersive surfactants that provide improved cleaning performance (e.g, removal of laundry soils) in dry cleaning applications. Method for using the compositions in a dry cleaning application is also provided.

6 Claims, No Drawings

U.S. PATENT DOCUMENTS

| | | | | |
|---|---|---|---|---|
| 2003/0074742 | A1 | 4/2003 | Perry et al. | |
| 2003/0078184 | A1* | 4/2003 | Deak et al. | 510/475 |
| 2003/0081793 | A1 | 5/2003 | Deak et al. | |
| 2003/0087793 | A1* | 5/2003 | Deak et al. | 510/466 |
| 2003/0104968 | A1* | 6/2003 | Deak et al. | 510/466 |
| 2003/0119711 | A1 | 6/2003 | Scheper et al. | |
| 2004/0142838 | A1 | 7/2004 | Azuma et al. | |
| 2004/0266643 | A1 | 12/2004 | Gardner et al. | |
| 2005/0000027 | A1 | 1/2005 | Baker et al. | |
| 2005/0000028 | A1 | 1/2005 | Baker et al. | |
| 2005/0000030 | A1 | 1/2005 | Dupont et al. | |
| 2005/0003981 | A1 | 1/2005 | Sivik et al. | |
| 2005/0009723 | A1 | 1/2005 | Haeggberg et al. | |

FOREIGN PATENT DOCUMENTS

| | | | |
|---|---|---|---|
| DE | 26 28 480 | A1 | 1/1978 |
| DE | 2644073 | A1 | 4/1978 |
| DE | 37 39 711 | A1 | 6/1989 |
| DE | 199 08 170 | A1 | 10/1999 |
| EP | 0 182 583 | | 5/1986 |
| EP | 0 246007 | | 11/1987 |
| EP | 0 375 028 | | 12/1989 |
| EP | 0 398 177 | | 11/1990 |
| EP | 1 041 189 | A1 | 10/2000 |
| EP | 1 092 803 | A1 | 4/2001 |
| EP | 1 304 158 | A1 | 4/2003 |
| GB | 1 252 744 | | 11/1971 |
| JP | 53018646 | A | 2/1978 |
| JP | 0 4245970 | | 9/1991 |
| JP | 5171566 | | 7/1993 |
| JP | 11323381 | | 11/1999 |
| JP | 2000-290689 | | 10/2000 |
| JP | 2003041290 | | 2/2003 |
| WO | WO 94/23012 | | 10/1997 |
| WO | WO 99/16955 | | 4/1999 |
| WO | WO 00/04221 | | 1/2000 |
| WO | WO 00/04222 | | 1/2000 |
| WO | WO 00/63340 | | 10/2000 |
| WO | WO 01/04254 | A1 | 1/2001 |
| WO | WO 01/40567 | A1 | 6/2001 |

* cited by examiner

FABRIC CARE COMPOSITION AND METHOD FOR USING SAME

CROSS REFERENCE TO RELATED APPLICATIONS

This application claims the benefit of U.S. Provisional Application Ser. No. 60/483,343, filed on Jun. 27, 2003.

FIELD OF THE INVENTION

The present invention relates to compositions for treating fabric articles. The compositions comprise novel detersive surfactants that provide improved cleaning performance (e.g., removal of laundry soils) in dry cleaning applications. Method for using the compositions in a dry cleaning application is also provided.

BACKGROUND

Cleaning applications typically involve the removal of foreign matter off surfaces. In laundry applications, this involves the removal of both hydrophobic and hydrophilic soils (food stains, blood, grass, dirt, grease, oils, etc.) off various fabrics including cotton, polyester, silk, rayon, wool and various blends of these materials.

For laundry applications, the consumer has two choices for removal of soils: conventional water based cleaning and dry cleaning (i.e., non-aqueous based cleaning). Compositions suitable for use in conventional water based fabric cleaning systems have been optimized over the years. Specifically, laundry detergents that include surfactants, enzymes, builders, bleaches, chelants, polymers and other additives have been shown to remove both hydrophilic and hydrophobic soils efficiently in a water based fabric cleaning system. More specifically, while cotton, polyester and various blends can be efficiently cleaned using conventional water based systems, other more delicate fabrics, such as silk, wool, and rayon, are prone to fabric damages or shrinkages caused by the water based cleaning process and generally rely on the dry cleaning process.

The dry cleaning process refers to a process where low or no water is used in the cleaning system; it uses various non-aqueous organic solvents, such as halocarbons, hydrocarbons, densified carbon dioxide, glycol ethers and silicones. Generally, water-sensitive fabrics such as silk, wool, rayon, and the like, are cleaned in this manner.

Conventional detergent compositions and additives designed for water based cleaning. It has been found that those conventional detergent additives, including anionic surfactants (e.g. linear alkyl benzenesulfonates, alkylethoxy sulfates), bleaches and polymers (e.g., ethoxylated polyamines) are not efficient cleaning agents in dry cleaning solvents due to low compatibility with these solvents.

Some additives, such as detersive surfactants, have been developed for dry cleaning applications. An important design feature of these additives is their enhanced compatibility with the dry cleaning solvents. Not limited in theory, it is believed that these detersive surfactants can boost detergency by solubilizing the target soils; by suspending water in the dry cleaning solvents or system, if low levels of water are utilized; and by forming reverse micelles that help trapping soils for removal from the system. Surfactant detergency has been discussed in "Detergency of Specialty Surfactants", by F. E. Friedli, Marcel Dekker, Inc., New York (1988). Use of surfactants in a dry cleaning application has been disclosed in U.S. Pat. No. 5,944,996; U.S. Pat. No. 6,548,466; U.S. Pat. No. 6,461,387; U.S. Pat. No. 6,148,644; and U.S. Pat. No. 6,114,295.

Accordingly, there is a continuing need to develop cleaning agents to enhance soil removal from various fabrics, including cotton, polycotton, polyester, silk, rayon, wool and various blends, in non-aqueous cleaning applications.

There is also a need to develop detergent additives or cleaning agents, such as detersive surfactants, that exhibit enhanced capability to solubilize laundry soils in the dry cleaning solvents. There is a further need that such detergent additives or cleaning agents have the capability to suspend water in the solvents or dry cleaning solvents or system, when water is used in the dry cleaning system.

SUMMARY OF INVENTION

In one aspect of the present invention, a composition having improved soil removal capability is provided. The composition comprises:

(a) a lipophilic fluid;

(b) a detersive surfactant having the general formula:

$$Y_u\text{-}(L_t\text{-}X_v)_x\text{—}Y'_w$$

wherein L is a solvent compatibilizing (or lipophilic) moiety selected from:

(1) C1-C22 alkyl, C2-C22 alkenyl, C6-C22 alkaryl, or C4-C12 alkoxy, linear or branched, cyclic or acyclic, saturated or unsaturated, substituted or unsubstituted;

(2) siloxanes having the formula:

$$M_aD_bD'_cD''_d$$

wherein a is 0-2; b is 0-1000; c is 0-50; d is 0-50, provided that a+c+d is at least 1;

M is $R^1_{3-e}X_eSiO_{1/2}$ wherein $R^1$ is independently H, or an alkyl group, X is hydroxyl group, and e is 0 or 1;

D is $R^4{}_2SiO_{2/2}$ wherein $R^4$ is independently H or an alkyl group;

D' is $R^5{}_2SiO_{2/2}$ wherein $R^5$ is independently H, an alkyl group, or $(CH_2)_f\text{—}(C_6Q_4)_g\ O\text{—}(C_2H_4O)_h\text{—}(C_3H_6O)_i\text{—}(C_kH_{2k}O)_j\text{—}R^3$, provided that at least one $R^5$ is $(CH_2)_f\text{—}(C_6Q_4)_g\ O\text{—}(C_2H_4O)_h\text{—}(C_3H_6O)_i\text{—}(C_kH_{2k}O)_j\text{—}R^3$, wherein $R^3$ is independently H, an alkyl group or an alkoxy group, f is 1-10, g is 0 or 1, h is 1-50, i is 0-50, j is 0-50, k is 4-8; and D" is $R^6{}_2SiO_{2/2}$ wherein $R^6$ is independently H, an alkyl group or $(CH_2)_l(C_6H_4)_m(A)_n\text{-}[(T)_o\text{-}(A')_p\text{-}]_q\text{-}(T')_rZ(G)_S$, wherein 1 is 1-10; m is 0 or 1; n is 0-5; o is 0-3; p is 0 or 1; q is 0-10; r is 0-3; s is 0-3;$C_6Q_4$ is unsubstituted with $C_{1-10}$ alkyl or $C_{1-10}$ alkenyl; Q is independently H, $C_{1-10}$ alkyl, $C_{1-10}$ alkenyl, or mixtures thereof; A and A' are each independently a linking moiety representing an ester, a keto, an ether, a thio, an amido, an amino, a $C_{1-4}$ fluoroalkyl, a $C_{1-4}$ fluoroalkenyl, a branched or straight chained polyalkylene oxide, a phosphate, a sulfonyl, a sulfate, an ammonium, and mixtures thereof; L and L' are each independently a $C_{1-30}$ straight chained or branched alkyl or alkenyl or an aryl which is unsubstituted or substituted; Z is a hydrogen, carboxylic acid, a hydroxy, a phosphato, a phosphate ester, a sulfonyl, a sulfonate, a sulfate, a branched or straight-chained polyalkylene oxide, a nitryl, a glyceryl, an aryl unsubstituted or substituted with a $C_{1-30}$alkyl or alkenyl, a carbohydrate unsubstituted or substituted with a $C_{1-10}$ alkyl or alkenyl or an ammonium; G is an anion or cation such as $H^+$, $Na^+$, $Li^+$, $K^+$, $NH_4^+$, $Ca^{+2}$, $Mg^{+2}$, $Cl^-$, $Br^-$, $I^-$, mesylate or tosylate; D" can be capped with C1-C4 alkyl or hydroxy groups;

Y and Y' are hydrophilic moieties, which are independently selected from hydroxy; polyhydroxy; C1-C3 alkoxy; mono-or di-alkanolamine; C1-C4 alkyl substituted alkanolamine; substituted heterocyclic containing O, S, N; sulfates; carboxylate; carbonate; and when H is ethoxy (EO) or propoxy (PO), it must be capped with R, which is selected from the group consisting of:

(i) a 4 to 8 membered, substituted or unsubstituted, heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

X is a bridging linkage selected from O; S; N; P; C-1 to C-22 alkyl, linear or branched, saturated or unsaturated, substituted or unsubstituted, cyclic or acyclic, aliphatic or aromatic, interrupted by O, S, N, P; glycidyl, ester, amido, amino, $PO_4^{2-}$, $HPO_4^-$, $PO_3^{2-}$, $HPO_3^-$, which are protonated or unprotonated;

u and w are integers independently selected from 0 to 20, provided that $u+w \geqq 1$;

t is an integer from 1 to 10;

v is an integer from 0 to 10; and x is an integer from 1 to 20.

(c) optionally, a polar solvent; and (d) optionally, at least one cleaning adjunct.

In another aspect of the present invention, a neat fabric care composition, before dilution with a lipophilic fluid, is also provide. The fabric care composition comprises:

(a) a detersive surfactant as described above;

(b) an auxiliary surfactant;

(c) optionally, a polar solvent, (d) optionally, other cleaning adjuncts; and (e) optionally, a lipophilic fluid;

In yet another aspect of the present invention, a method of using the composition to treat fabric article is provided.

DETAILED DESCRIPTION OF THE INVENTION

The term "fabric article" used herein is intended to mean any article that is customarily cleaned in a conventional laundry process or in a dry cleaning process. As such the term encompasses articles of clothing, linen, drapery, and clothing accessories. The term also encompasses other items made in whole or in part of fabric, such as tote bags, furniture covers, tarpaulins and the like.

The term "lipophilic fluid" used herein is intended to mean any non-aqueous fluid capable of removing sebum, as described in more detail herein below.

The term "cleaning composition" as used herein means any dry cleaning solvent-containing composition that comes into direct contact with fabric articles to be cleaned. It should be understood that the composition may have uses other than cleaning, such as conditioning, sizing, and other fabric care treatments. Thus, it may be used interchangeably with the terms "treating composition" or "fabric care composition". Furthermore, optional cleaning adjuncts such as additional detersive surfactants, bleaches, perfumes, and the like may be added to the "cleaning composition". That is, cleaning adjuncts may be optionally combined with the dry cleaning solvent. These optional cleaning adjuncts are described in more detail herein below.

The term "dry cleaning" or "non-aqueous cleaning" as used herein means a non-aqueous fluid is used as the dry cleaning solvent to clean a fabric article. However, water can be added to the "dry cleaning" method as an adjunct cleaning agent. The amount of water can comprise up to about 25% by weight of the dry cleaning solvent or the cleaning composition in a "dry cleaning" process. The non-aqueous fluid is referred to as the "lipophilic fluid" or "dry cleaning solvent".

The term "soil" means any undesirable substance on a fabric article that is desired to be removed. By the terms "water-based" or "hydrophilic" soils, it is meant that the soil comprised water at the time it first came in contact with the fabric article, that the soil has high water solubility or affinity, or the soil retains a significant portion of water on the fabric article. Examples of water-based soils include, but are not limited to beverages, many food soils, water soluble dyes, bodily fluids such as sweat, urine or blood, outdoor soils such as grass stains and mud. On the other hand, the term "lipophilic" soils, as used herein means the soil has high solubility in or affinity for the lipophilic fluid. Examples of lipophilic soils include, but are not limited to, mono-, di-, and tri-glycerides, saturated and unsaturated fatty acids, non-polar hydrocarbons, waxes and wax esters, lipids, other body soils, and mixtures thereof.

The term "capable of suspending water in a lipophilic fluid" means that a material is able to suspend, solvate or emulsify water, which is immiscible with the lipophilic fluid, in a way that the water remains visibly suspended, solvated or emulsified when left undisturbed for a period of at least five minutes after initial mixing of the components The term "insoluble in a lipophilic fluid" means that when added to a lipophilic fluid, a material physically separates from the lipophilic fluid (i.e. settle-out, flocculate, float) within 5 minutes after addition, whereas a material that is "soluble in a lipophilic fluid" does not physically separate from the lipophilic fluid within 5 minutes after addition.

Lipophilic Fluid

"Lipophilic fluid" as used herein means any liquid or mixture of liquid that is immiscible with water at up to 20% by weight of water. In general, a suitable lipophilic fluid can be fully liquid at ambient temperature and pressure, can be an easily melted solid, e.g., one that becomes liquid at temperatures in the range from about 0° C. to about 60° C., or can comprise a mixture of liquid and vapor phases at ambient temperatures and pressures, e.g., at 25° C. and 1 atm. pressure.

It is preferred that the lipophilic fluid herein be non-flammable or, have relatively high flash points and/or low VOC characteristics, these terms having conventional meanings as used in the dry cleaning industry, to equal or, preferably, exceed the characteristics of known conventional dry cleaning fluids.

Non-limiting examples of suitable lipophilic fluid materials include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof.

"Siloxane" as used herein means silicone fluids that are non-polar and insoluble in water or lower alcohols. Linear siloxanes (see for example U.S. Pat. Nos. 5,443,747, and 5,977,040) and cyclic siloxanes are useful herein, including the cyclic siloxanes selected from the group consisting of octamethyl-cyclotetrasiloxane (tetramer), dodecamethyl-cyclohexasiloxane (hexamer), and preferably decamethyl-cyclopentasiloxane (pentamer, commonly referred to as "D5"). A preferred siloxane comprises more than about 50% cyclic siloxane pentamer, more preferably more than about 75% cyclic siloxane pentamer, most preferably at least about 90% of the cyclic siloxane pentamer. Also preferred for use herein are siloxanes that are a mixture of cyclic siloxanes having at least about 90% (preferably at least about 95%) pentamer and less than about 10% (preferably less than about 5%) tetramer and/or hexamer.

The lipophilic fluid can include any fraction of dry-cleaning solvents, especially newer types including fluorinated solvents, or perfluorinated amines. Some perfluorinated amines such as perfluorotributylamines, while unsuitable for use as lipophilic fluid, may be present as one of many possible adjuncts present in the lipophilic fluid-containing composition.

Other suitable lipophilic fluids include, but are not limited to, diol solvent systems e.g., higher diols such as $C_6$ or $C_8$ or higher diols, organosilicone solvents including both cyclic and acyclic types, and the like, and mixtures thereof.

Non-limiting examples of low volatility non-fluorinated organic solvents include for example OLEAN® and other polyol esters, or certain relatively nonvolatile biodegradable mid-chain branched petroleum fractions.

Non-limiting examples of glycol ethers include propylene glycol methyl ether, propylene glycol n-propyl ether, propylene glycol t-butyl ether, propylene glycol n-butyl ether, dipropylene glycol methyl ether, dipropylene glycol n-propyl ether, dipropylene glycol t-butyl ether, dipropylene glycol n-butyl ether, tripropylene glycol methyl ether, tripropylene glycol n-propyl ether, tripropylene glycol t-butyl ether, tripropylene glycol n-butyl ether.

Non-limiting examples of other silicone solvents, in addition to the siloxanes, are well known in the literature, see, for example, Kirk Othmer's Encyclopedia of Chemical Technology, and are available from a number of commercial sources, including GE Silicones, Toshiba Silicone, Bayer, and Dow Corning. For example, one suitable silicone solvent is SF-1528 available from GE Silicones.

Non-limiting examples of glycerine derivative solvents include materials having the following structure:

Non-limiting examples of suitable glycerine derivative solvents for use in the methods and/or apparatuses of the present invention include glyercine derivatives having the following structure:

Structure I

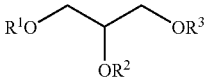

wherein $R^1$, $R^2$ and $R^3$ are each independently selected from: H; branched or linear, substituted or unsubstituted $C_1$-$C_{30}$ alkyl, $C_2$-$C_{30}$ alkenyl, $C_1$-$C_{30}$ alkoxycarbonyl, $C_3$-$C_{30}$ alkyleneoxyalkyl, $C_1$-$C_{30}$ acyloxy, $C_7$-$C_{30}$ alkylenearyl; $C_4$-$C_{30}$ cycloalkyl; $C_6$-$C_{30}$ aryl; and mixtures thereof. Two or more of $R^1$, $R^2$ and $R^3$ together can form a $C_3$-$C_8$ aromatic or non-aromatic, heterocyclic or non-heterocyclic ring.

Non-limiting examples of suitable glycerine derivative solvents include 2,3-bis(1,1-dimethylethoxy)-1-propanol; 2,3-dimethoxy-1-propanol; 3-methoxy-2-cyclopentoxy-1-propanol; 3-methoxy-1-cyclopentoxy-2-propanol; carbonic acid (2-hydroxy-1-methoxymethyl)ethyl ester methyl ester; glycerol carbonate and mixtures thereof.

Non-limiting examples of other environmentally-friendly solvents include lipophilic fluids that have an ozone formation potential of from about 0 to about 0.31, lipophilic fluids that have a vapor pressure of from about 0 to about 0.1 mm Hg, and/or lipophilic fluids that have a vapor pressure of greater than 0.1 mm Hg, but have an ozone formation potential of from about 0 to about 0.31. Non-limiting examples of such lipophilic fluids that have not previously been described above include carbonate solvents (i.e., methyl carbonates, ethyl carbonates, ethylene carbonates, propylene carbonates, glycerine carbonates) and/or succinate solvents (i.e., dimethyl succinates).

"Ozone Reactivity" as used herein is a measure of a VOC's ability to form ozone in the atmosphere. It is measured as grams of ozone formed per gram of volatile organics. A methodology to determine ozone reactivity is discussed further in W. P. L. Carter, "Development of Ozone Reactivity Scales of Volatile Organic Compounds", Journal of the Air & Waste Management Association, Vol. 44, Page 881-899, 1994. "Vapor Pressure" as used can be measured by techniques defined in Method 310 of the California Air Resources Board.

Preferably, the lipophilic fluid comprises more than 50% by weight of the lipophilic fluid of cyclopentasiloxane (such as D5) and/or linear analogs having approximately similar volatility, and optionally complemented by other silicone solvents.

The level of lipophilic fluid, when present in the treating compositions according to the present invention, is preferably from about 70% to about 99.99%, more preferably from about 90% to about 99.9%, and even more preferably from about 95% to about 99.8% by weight of the treating composition.

Fabric Care Composition

The fabric care composition of the present invention comprises a lipophilic fluid, a detersive surfactant, and optionally, water and/or cleaning adjuncts.

The detersive surfactant component, when present in the fabric care compositions of the present invention, preferably comprises from about 1% to about 99%, more preferably 2% to about 75%, even more preferably from about 5% to about 60% by weight of the composition.

The composition may optionally comprise a polar solvent, e.g., water, ranging from about 99% to about 1%, preferably from about 5% to about 40%, by weight of the composition; and cleaning adjuncts ranging from about 0.01% to about 50%, preferably from about 5% to about 30%, by weight of the composition When the composition is diluted with a lipophilic fluid to prepare the wash liquor, the fabric care composition comprises from about 0.1% to about 50%, more preferably from about 1% to about 30%, even more preferably from about 2% to about 10% by weight of the wash liquor. Moreover, the amount of the above detersive surfactant in the wash liquor is in the range from about 0.001% to about 50%, preferably from about 1% to about 40%, and more preferably from about 2% to about 30% by weight of the wash liquor.

In some embodiments, water may optionally be incorporated into the wash liquor as well. Water may be added as a component of the fabric care composition or as a co-solvent of the lipophilic fluid.

Cleaning Adjuncts

Fabric care compositions useful herein may comprise cleaning adjuncts. "Cleaning adjuncts" as used herein, means additives useful in a lipophilic fluid-based cleaning system selected from those materials that can be safely disposed down the drain within all constraints on environmental fate and toxicity (e.g. biodegradability, aquatic toxicity, pH, etc.). Although solubility in water or lipophilic fluid is not necessarily required, preferred materials are simultaneously soluble in both water and lipophilic fluid.

Some suitable cleaning adjuncts include, but are not limited to, builders, enzymes, bleach activators, bleach catalysts, bleach boosters, bleaches, alkalinity sources, antibacterial agents, colorants, perfumess, pro-perfumes, finishing aids, lime soap dispersants, odor control agents, odor neutralizers, polymeric dye transfer inhibiting agents, crystal growth inhibitors, photo bleaches, heavy metal ion sequestrants, anti-tarnishing agents, anti-microbial agents, anti-oxidants, anti-redeposition agents, soil release polymers, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters and mixtures thereof.

These cleaning adjuncts vary widely and are typically incorporated into the composition at an effective amount sufficient to deliver the desired benefit the particular cleaning adjunct is designed for. When present, each cleaning adjunct may, though not required to, comprise from about 0.01% to about 20%, preferably from about 0.1% to about 10%, and more preferably from about 1% to about 5%, by weight of the composition.

Detersive Surfactants

The detersive surfactant suitable for use in the present invention has the general formula:

$$Y_u\text{-}(L_t\text{-}X_v)_x\text{—}Y'_w$$

wherein L is a solvent compatibilizing (or lipophilic) moiety selected from:

1. C1-C22 alkyl, C2-C22 alkenyl, C6-C22 alkaryl, or C4-C12 alkoxy, linear or branched, cyclic or acyclic, saturated or unsaturated, substituted or unsubstituted;
2. siloxanes having the formula:

$$M_aD_bD'_cD''_d$$

wherein a is 0-2; b is 0-1000; c is 0-50; d is 0-50, provided that a+c+d is at least 1;

M is $R^1_{3-e}X_eSiO_{1/2}$ wherein $R^1$ is independently H, or an alkyl group, X is hydroxyl group, and e is 0 or 1;

D is $R^4_2SiO_{2/2}$ wherein $R^4$ is independently H or an alkyl group;

D' is $R^5_2SiO_{2/2}$ wherein $R^5$ is independently H, an alkyl group, or $(CH_2)_f\text{—}(C_6Q_4)_g\ O\text{—}(C_2H_4O)_h\text{—}(C_3H_6O)_i\text{—}(C_kH_{2k}O)_j\text{—}R^3$, provided that at least one $R^5$ is $(CH_2)_f\text{—}(C_6Q_4)_g\ O\text{—}(C_2H_4O)_h\text{—}(C_3H_6O)_i\text{—}(C_kH_{2k}O)_j\text{—}R^3$, wherein $R^3$ is independently H, an alkyl group or an alkoxy group, f is 1-10, g is 0 or 1, h is 1-50, i is 0-50, j is 0-50, k is 4-8; and D" is $R^6_2SiO_{2/2}$ wherein $R^6$ is independently H, an alkyl group or $(CH_2)_l(C_6H_4)_m(A)_n\text{-}[(T)_o\text{—}(A')_p\text{-}]_q\text{-}(T')_rZ(G)_s$, wherein 1 is 1-10; m is 0 or 1; n is 0-5; o is 0-3; p is 0 or 1; q is 0-10; r is 0-3; s is 0-3;$C_6Q_4$ is unsubstituted or substituted with $C_{1-10}$ alkyl or $C_{1-10}$ alkenyl; Q is independently H, $C_{1-10}$ alkyl, $C_{1-10}$ alkenyl, or mixtures thereof; A and A' are each independently a linking moiety representing an ester, a keto, an ether, a thio, an amido, an amino, a $C_{1-4}$ fluoroalkyl, a $C_{1-4}$ fluoroalkenyl, a branched or straight chained polyalkylene oxide, a phosphate, a sulfonyl, a sulfate, an ammonium, and mixtures thereof; T and T' are each independently a $C_{1-30}$ straight chained or branched alkyl or alkenyl or an aryl which is unsubstituted or substituted; Z is a hydrogen, carboxylic acid, a hydroxy, a phosphato, a phosphate ester, a sulfonyl, a sulfonate, a sulfate, a branched or straight-chained polyalkylene oxide, a nitryl, a glyceryl, an aryl unsubstituted or substituted with a $C_{1-30}$alkyl or alkenyl, a carbohydrate unsubstituted or substituted with a $C_{1-10}$ alkyl or alkenyl or an ammonium; G is an anion or cation such as $H^+$, $Na^+$, $Li^+$, $K^+$, $NH_4^+$, $Ca^{+2}$, $Mg^{+2}$, $Cl^-$, $Br^-$, $I^-$, mesylate or tosylate;

D" can be capped with C1-C4 alkyl or hydroxy groups;

Y and Y' are hydrophilic moieties, which are independently selected from hydroxy; polyhydroxy; C1-C3 alkoxy; mono-or di-alkanolamine; C1-C4 alkyl substituted alkanolamine; substituted heterocyclic containing O, S, N; sulfates; carboxylate; carbonate; and when Y and/or Y' is ethoxy (EO) or propoxy (PO), it must be capped with R, which is selected from the group consisting of:

(i) a 4 to 8 membered, substituted or unsubstituted, heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

X is a bridging linkage selected from O; S; N; P; C-1 to C-22 alkyl, linear or branched, saturated or unsaturated, substituted or unsubstituted, cyclic or acyclic, aliphatic or aromatic, interrupted by O, S, N, P; glycidyl, ester, amido, amino, $PO_4^{2-}$, $HPO_4^-$, $PO_3^{2-}$, $HPO_3^-$, which protonated or unprotonated;

u and w are integers independently selected from 0 to 20, provided that $u+w \geqq 1$;

t is an integer from 1 to 10;

v is an integer from 0 to 10; and x is an integer from 1 to 20.

Nonlimiting examples of detersive surfactants that provided improved soil removal from fabrics in a lipophilic fluid include (1) alkanolamines;

(2) phosphate/phosphonate esters;

(3) gemini surfactants including, but are not limited to, gemini diols, gemini amides, gemini amide alkoxylates, gemini amino alkoxylates;

(4) capped nonionic surfactants;

(5) amides;

(6) silicone surfactants such as nonionic silicone ethoxylates, silicone amine derivatives;

(7) alkyl alkoxylates; and mixtures thereof.

A typical fabric care composition of the present invention may comprise from about 1 to about 50 wt % of at least one detersive surfactant disclosed above, from about 1 to about 20 wt % of water, from about 0.1 to about 20 wt % of cleaning adjuncts. Such composition has been shown to enhance the overall cleaning and soil/stain removal performance in comparison with compositions that do not contain the above detersive surfactants. Moreover, it has been found that certain detersive surfactants are particularly effective in removing certain soils or stains.

Alkanolamine-Containing Surfactants:

Alkanolamine surfactants have the ability to aid in cleaning for water-soluble and water-based soils. However, the alkanolamine moieties alone may not have good compatibility in lipophilic fluid such as decamethylcyclopentasiloxane. Linking the alkanolamine moieties to suitable lipophilic moieties can enhance the surfactant/solvent compatibility.

Suitable alkanolamine surfactants would have the general formula (I) wherein the Y moiety may comprise an alkanolamine moiety having the following formula:

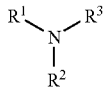

wherein $R^1$, $R^2$, $R^3$ are same or different and are independently selected from H, alkyls, polyoxyalkylenes, siloxanes or fluorinated groups; and at least one hydroxyl group is present in the alkanolamine moiety, either to terminate one or more R groups or be present within one or more of the R groups. The alkyl groups may be linear or branched, cyclic or acyclic, saturated or unsaturated, and contain about 1-30 carbons, preferably about 6 to 30 carbons, more preferably about 8 to 18 carbons. Silicone and fluorinated groups may consist of 1-50 repeat units.

The method of functionalizing the alkanolamine moiety may be, but not limited to alkylation, esterification, etherification, amidation, amination and other linking chemistries. Thus, the corresponding bridging group B can be alkyl, ester, ether, amido, and amino linking groups.

The number and size of the lipophilic moieties T associated with a given alkanolamine group is important for optimized the performance of the surfactant. When a detersive surfactant contains too numerous and/or too large lipophilic moieties, the detersive surfactant may exhibit too high a solubility profile in the solvent or too high a molecular weight, both of which lead to ineffective cleaning and/or soil removal performance. In some cases, the detersive surfactant may become a solid, which makes solubiliztion in the solvent and formulation difficulty. On the other hand, when the detersive surfactant contains too few and/or too small lipophilic moieties, the detersive surfactant may exhibit poor solubility in the solvent and reduce the effectiveness of the alkanolamine moiety in cleaning and/or soil removal.

Suitable alkanolamine surfactants may comprise one or more alkylene oxide (alkoxy) or polyalkylene oxide units, or the solvent compatibilizing (i.e., lipophilic) moieties T, within the surfactant structure. The alkoxy moieties are selected from ethoxy (EO); propoxy (PO); butoxy (BO); higher alkoxy moieties; mixed alkoxy moieties, such as mixed EO/PO, EO/B, PO/BO, EO/PO/BO, and the like; and mixtures thereof; wherein the amount of alkoxylation (m) may be from 1 to 50 alkoxy units. It is recognized that the amount of alkoxylation of the alkanolamine surfactants may be either a distribution with an average value of m, or monodispersed with a degree of alkoxylation.

In one embodiment of the present invention, the functionalized alkanolamine moiety has an average of at least one T moiety per surfactant molecule. Preferably, the surfactant molecules contains sufficient number of T moieties to provide solvent compatibility. In another embodiment of the invention, the alkanolamine moiety has an average of at least 2 solvent compatibilizing T moieties per alkanolamine moiety (i.e., a moiety having a "twin tail" structure). The T moiety can be selected from OH, alkoxy, and mixtures thereof.

The following are nonlimiting examples of functionalized alkanolamine containing surfactants useful in the present invention:

I

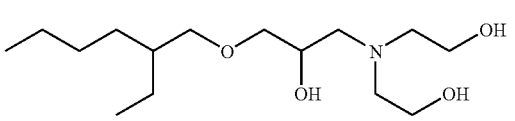

II

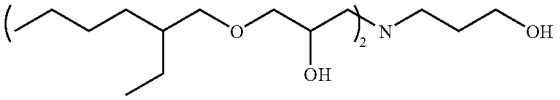

III

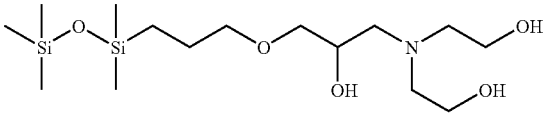

IV

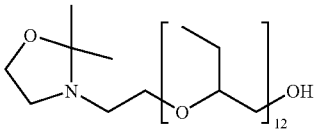

V

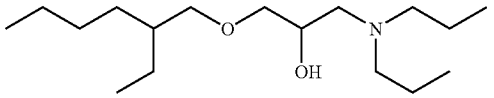

VI

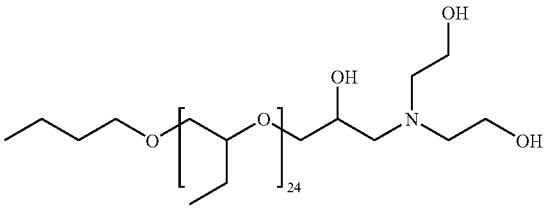

In some embodiments, the fabric care composition comprises from about 0.01 to about 10 wt % of an alkanolamine surfactant, from about 0 to about 20 wt % of water, from about 0.1 to about 20 wt % of other detergent adjuncts, and the balance of lipophilic fluids. These cleaning compositions have been shown to enhance the overall cleaning and stain removal performance of the composition. These compositions are shown to be particularly effective in the cleaning and removing stains of blood, grass and clay.

Phosphate/Phosphonate Ester Surfactants

These surfactants would have the general formula (I) wherein the X moiety can be a phosphate based moiety having the following formula:

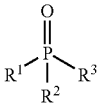

wherein $R^1$, $R^2$, $R^3$ are independently selected from H, $OR^4$, $C_1$-$C_{22}$ alkyl, which are linear or branched, substituted or unsubstituted, cyclic or acyclic, and optionally interrupted by O, N, S, or P; $R^4$ is selected from:

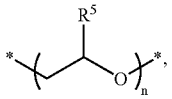

H, Na, K, Li, tri-alkylammonium, $C_1$-$C_{22}$ alkyl, which are linear or branched, substituted or unsubstituted, cyclic or acyclic, and optionally interrupted by O, N, S, or P; $R^5$ is selected from H, $CH_3$, $C_2H_5$, $C_3H_7$, $C_4H_9$; and n is an integer from 0 to 10.

The following are nonlimiting examples of functionalized phosphate ester containing surfactants useful in the present invention:

I

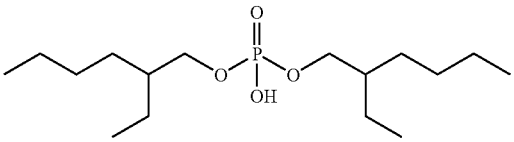

II

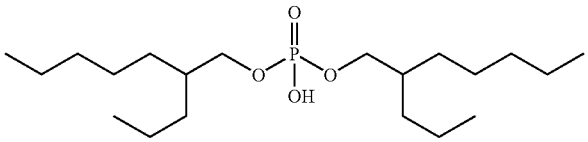

III

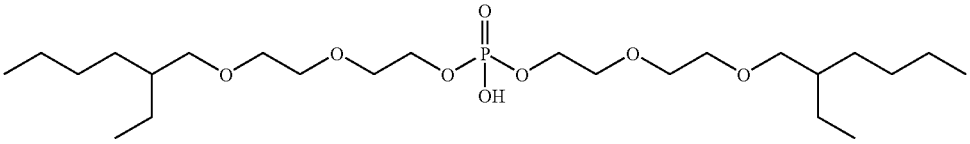

IV

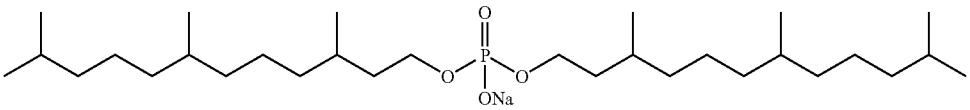

V

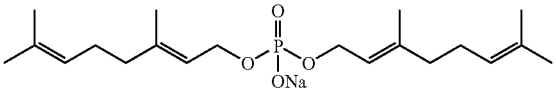

VI

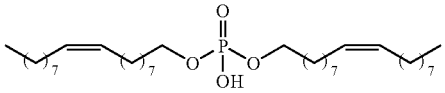

In some embodiments, the fabric care composition comprises from about 0.01 to about 10 wt % of a phosphate based surfactant, from about 0 to about 20 wt % of water, from about 0.1 to about 20 wt % of other cleaning adjuncts, and the balance of lipophilic fluids. These cleaning compositions have been shown to enhance the overall cleaning and stain removal performance of the composition. These compositions are particularly effective in the cleaning and removing stains of blood, grass and tea.

Gemini Surfactants

Whereas the conventional surfactants generally have one hydrophilic group and one hydrophobic group, the Gemini surfactants are compounds having at least two hydrophobic groups and at least two hydrophilic groups. See *J. American Chemical Soc.,* 115, 10083-10090 (1993); and *Chemtech*, March 1993, pp 30-33. Gemini surfactants have been found to be very effective emulsifiers when used at very low concentrations in comparison to conventional surfactants. This characteristic further leads to superior detergency at very low concentrations.

The following are nonlimiting examples of Gemini surfactants suitable for use in the present invention:

I

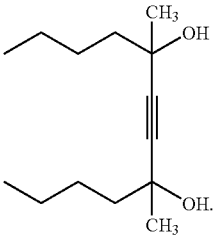

II

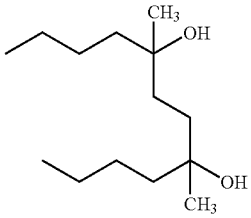

III

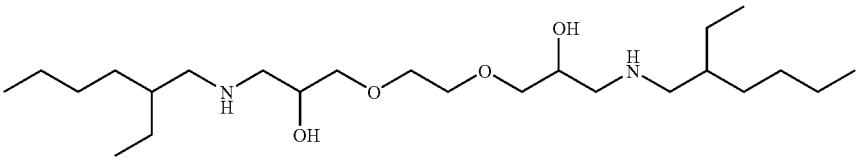

-continued

IV

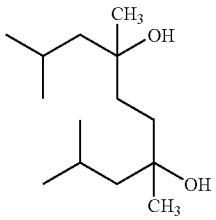

In some embodiments, the fabric care composition comprises from about 0.01 to about 10 wt % of a gemini surfactant, from about 0 to about 20 wt % of water, from about 0.1 to about 20 wt % of other cleaning adjuncts, and the balance of lipophilic fluids. These cleaning compositions have been shown to enhance the overall cleaning and stain removal performance of the composition. These compositions are particularly effective in the cleaning and removing clays and make-up stains.

Capped Nonionic Surfactants

In one embodiment of the present invention, the capped nonionic surfactant according to formula (i) can have the general formula:

$$R^1O[CH_2CH(R^3)O]_x[CH_2]_kCH(OH)[CH_2]_jO_nR^2$$

wherein $R^1$ and $R^2$ are linear or branched, saturated or unsaturated, aliphatic or aromatic hydrocarbon radicals having from about 1 to about 30 carbon atoms; $R^3$ is H, or a linear aliphatic hydrocarbon radical having from about 1 to about 4 carbon atoms; x is an integer having an average value from 1 to about 40, wherein when x is 2 or greater, $R^3$ may be the same or different and k and j are integers having an average value of from about 1 to about 12, and more preferably 1 to about 5, n is an integer from 0 to 1; further wherein when x is 15 or greater and $R^3$ is H and methyl, at least four of $R^3$ are methyl, further wherein when x is 15 or greater and $R^3$ includes H and from 1 to 3 methyl groups, then at least one $R^3$ is ethyl, propyl or butyl, further wherein $R^2$ can optionally be alkoxylated, wherein said alkoxy is selected from ethoxy, propoxy, butyloxy and mixtures thereof;

In another embodiment of the capped nonionic surfactant having the above general formula, $R^1$ and $R^2$ are preferably linear or branched, saturated or unsaturated, aliphatic or aromatic hydrocarbon radicals having from about 6 to about 22 carbon atoms with about 8 to about 18 carbon atoms being most preferred. $R^2$ can optionally be alkoxylated, wherein the alkoxy is selected from ethoxy, propoxy, butyloxy and mixtures thereof. H or a linear aliphatic hydrocarbon radical having from about 1 to about 2 carbon atoms is most preferred for $R^3$. Preferably, x is an integer having an average value of from about 1 to about 20, more preferably from about 6 to about 15.

In another embodiment of the present invention, the capped nonionic surfactant according to formula (i) can be an ether-capped poly(oxyalkylated) alcohol surfactant, specifically, with the formula:

$$RO(R^1O)_xCH(CH_3)OR^2$$

wherein, R is selected from the group consisting of linear or branched, saturated or unsaturated, substituted or unsubstituted, aliphatic or aromatic hydrocarbon radicals having from about 1 to about 30 carbon atoms; $R^1$ may be the same or different, and is independently selected from the group consisting of branched or linear $C_2$ to $C_7$ alkylene in any given molecule; x is a number from 1 to about 30; and $R^2$ is selected from the group consisting of:

(iii) a 4 to 8 membered substituted, or unsubstituted heterocyclic ring containing from 1 to 3 hetero atoms; and (iv) linear or branched, saturated or unsaturated, substituted or unsubstituted, cyclic or acyclic, aliphatic or aromatic hydrocarbon radicals having from about 1 to about 30 carbon atoms;

provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

In yet another embodiment of the present invention, the capped nonionic surfactant according to formula (i) can be an ether-capped poly(oxyalkylated) alcohols having the formula:

$$RO(R^1O)_xR^2$$

In one aspect of the present invention R is a linear or branched, saturated or unsaturated, substituted or unsubstituted, aliphatic hydrocarbon radical having from about 1 to about 20 carbon atoms, even more preferably R is a linear or branched, saturated, aliphatic hydrocarbon radicals having from about 4 to about 18 carbon atoms.

In another aspect of the present invention R, $R^1$ and $R^2$ are selected such that the ether-capped poly(oxyalkylated) alcohol surfactant contains one or more chiral carbon atoms.

In one aspect of the present invention, R is a hydrocarbon radical of the formula:

$$CH_3(CH_2)_qCH(R^4)(CH_2)_rCH(R^5)(CH_2)_sCH(R^6)(CH_2)_tCH_2-$$

wherein $R^4$, $R^5$, and $R^6$ are each independently selected from hydrogen, and $C_1$-$C_3$ alkyl, , more preferably hydrogen, $C_1$-$C_2$ alkyl, even more preferably hydrogen, and methyl, provided that $R^4$, $R^5$, and $R^6$ are not all hydrogen and, when t is 0, at least $R^4$ or $R^5$ is not hydrogen; q, r, s, t are each independently integers from 0 to 13. In one more preferred form of this aspect R is selected from the formulas:

$$CH_3(CH_2)_nCH(CH_3)(CH_2)_mCH_2-, \quad CH_3(CH_2)_jCH(CH_3)(CH_2)_kCH(CH_3)CH_2-$$

wherein n, m, j and k are each independently integers from 0 to 13.

In yet another aspect of the present invention $R^2$ is a hydrocarbon radical of the formula:

$$—C(CH_3)_2R^3$$

$R^3$ is selected from the group consisting of linear or branched, saturated or unsaturated, substituted or unsubstituted, aliphatic or aromatic hydrocarbon radicals having from about 1 to about 30, more preferably 1 to 20, even more preferably 1 to 15, carbon atoms, provided that when $R^3$ is methyl, R is branched. In one embodiment of this aspect of the present invention, $R^3$ is ethyl.

In a further aspect of the present invention $R^2$ is a 4 to 8 membered substituted, or unsubstituted heterocyclic ring containing from 1 to 3 hetero atoms. In one embodiment of this aspect of the invention the hetero atoms are selected from the group comprising oxygen, nitrogen, sulfur and mixtures thereof. In one embodiment of this aspect of the invention $R^2$ is a 5 or 6 member heterocycle. In another embodiment of this aspect of the present invention $R^2$ is selected from the group consisting of:

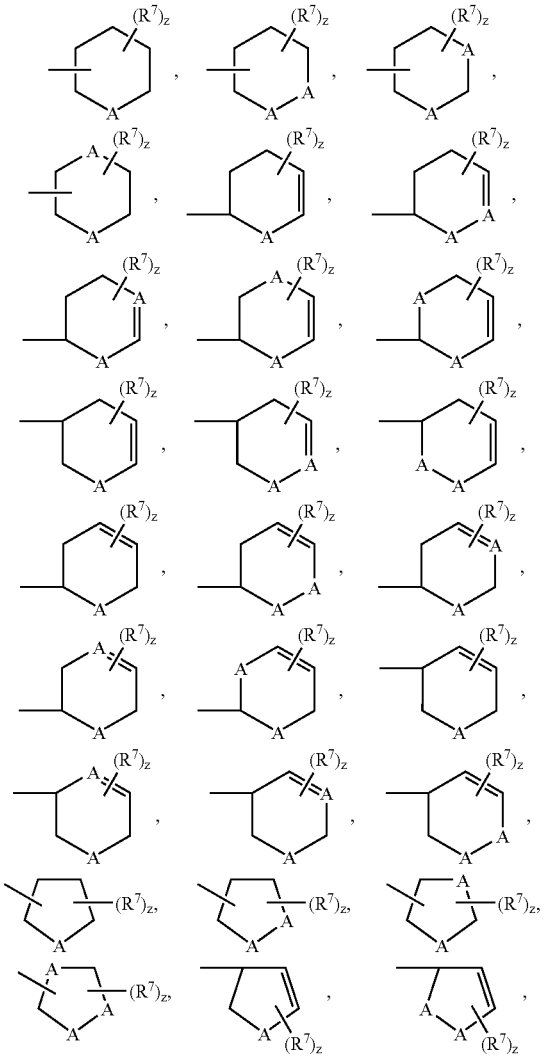

-continued

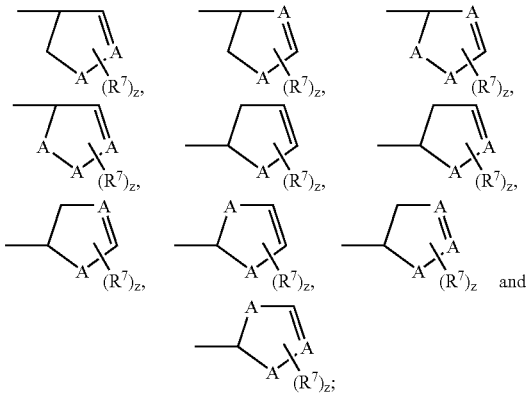

wherein each $R^7$ is independently selected from the group consisting of hydrogen, linear or branched, saturated or unsaturated, substituted or unsubstituted, aliphatic hydrocarbon or alkoxy radical having from about 1 to about 10 carbon atoms, or $R^7$ is a saturated or unsaturated, substituted or unsubstituted, alicyclic or aromatic hydrocarbon radical having, from about 1 to about 10 carbon atoms, which is fused to the heterocyclic ring; each A is independently selected from the group consisting of O, and $N(R^8)_a$, wherein $R^8$ is independently selected from the group consisting of hydrogen, linear or branched, saturated or unsaturated, substituted or unsubstituted, aliphatic hydrocarbon radical having from about 1 to about 10 carbon atoms, and a is either 0 or 1; z is an integer from 1 to 3.

In another embodiment of this aspect of the present invention $R^2$ is selected from the group consisting of:

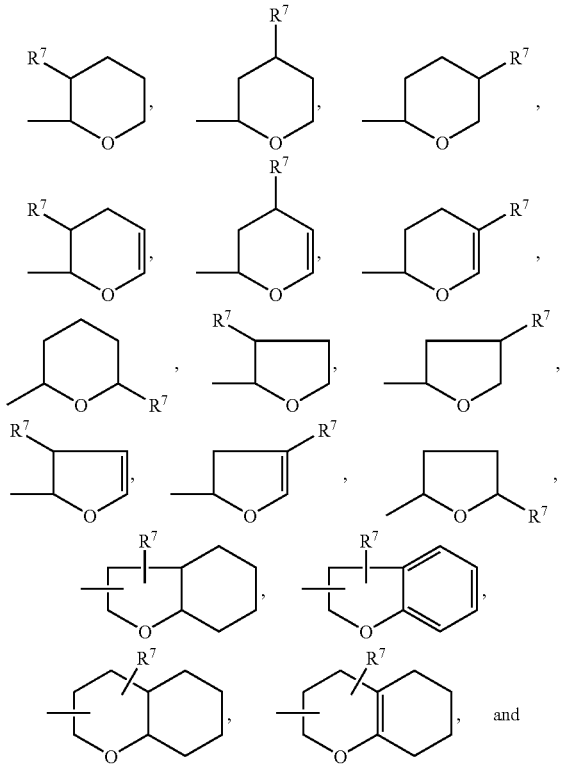

-continued

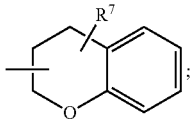

wherein $R^7$ is defined as above.

The following are nonlimiting examples of capped nonionic surfactants suitable for use in the present invention:

I

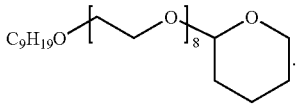

II

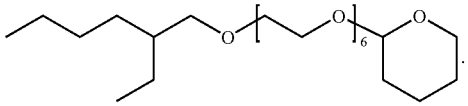

III

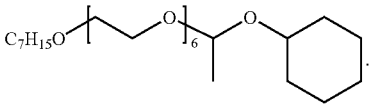

IV

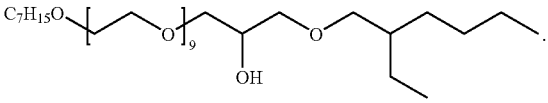

V

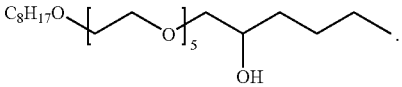

In some embodiments, the fabric care composition comprises from about 0.01 to about 10 wt % of a capped nonionic surfactant, from about 0 to about 20 wt % of water, from about 0.1 to about 20 wt % of other detergent adjuncts, and the balance of lipophilic fluids.

Suitable nonionic surfactants can have a HLB (hydrophile-lipophile balance) value of about 12 or less, preferably of about 10 or less, and more preferably of about 8 or less.

These cleaning compositions have been shown to enhance the overall cleaning and stain removal performance of the composition. These compositions are shown to be particular effective in the cleaning and removing stains of grass and clay.

Silicone Nonionic Surfactants

Silicone surfactants suitable for use herein would have the general formula (I) wherein the silicone-containing moiety is capped with a hydrophilic moiety. One embodiment of such surfactant has the following formula:

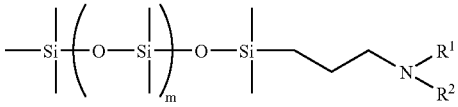

wherein $R^1$ and $R^2$ may be same or different and are independently selected from H, $—(R_3O)_n—R_4$, wherein $R_3$ is C2-C4 alkylene; $R_4$ is H, $OSO_3O—$, linear or branched, saturated or unsaturated, aliphatic or aromatic hydrocarbon radicals having 1-30 carbon atoms; and m is an integer from 1 to 200.

Amides

In one embodiment of the present invention, the amide containing surfactant according to formula (I) can have the general formulas:

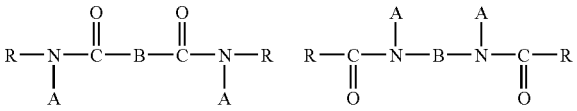

wherein R is selected from C1-C22 linear alkyl, alkyl substituted aromatic, C3-C22 branched alkyl, linear alkenyl, branched alkenyl, C5-C22 cyclic alkyl, cyclic alkenyl, aryl;

A is selected from:

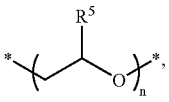

H, Na, K, Li, C1-$C_{22}$ alkyl, which are linear or branched, substituted or unsubstituted, cyclic or acyclic, and optionally interrupted by O, N, S, or P; $R^5$ is selected from H, $CH_3$, $C_2H_5$, $C_3H_7$, $C_4H_9$; and n is an integer from 0 to 20

The following are nonlimiting examples of amide surfactants useful in the present invention:

I

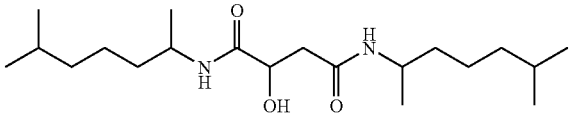

II

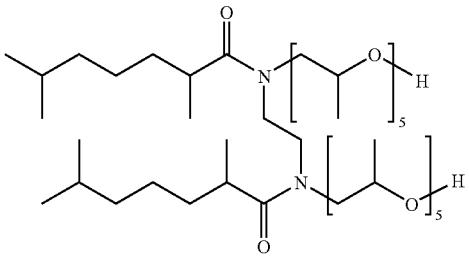

III

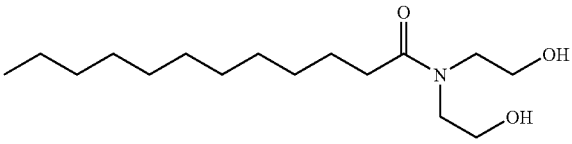

In some embodiments, the fabric care composition comprises from about 0.01 to about 10 wt % of a amide surfactant, from about 0 to about 20 wt % of water, from about 0.1 to about 20 wt % of other detergent adjuncts, and the balance of lipophilic fluids. These cleaning compositions have been shown to enhance the overall cleaning and stain removal performance of the composition. These compositions are particularly effective in the cleaning and removing stains of grass.

Auxiliary Surfactants

The composition may optionally comprise auxiliary surfactants to further enhance the cleaning or soil removal capability of the composition.

One class of suitable auxiliary surfactants includes siloxane-based surfactants, which comprise a polyether siloxane having the formula:

$$M_aD_bD'_cD''_dM'_{2-a}$$

wherein a is 0-2; b is 0-1000; c is 0-50; d is 0-50, provided that a+c+d is at least 1;

M is $R^1_{3-e}X_eSiO_{1/2}$ wherein $R^1$ is independently H, or an alkyl group, X is hydroxyl group, and e is 0 or 1;

M' is $R^2_3SiO_{1/2}$ wherein $R^2$ is independently H, an alkyl group, or $(CH_2)_f(C_6Q_4)_qO—(C_2H_4O)_h—(C_3H_6O)_i(C_kH_{2k})_j—R^3$, provided that at least one $R^2$ is $(CH_2)_f(C_6Q_4)_qO—(C_2H_4O)_h—(C_3H_6O)_iC_kH_{2k})_j—R^3$, wherein $R^3$ is independently H, an alkyl group or an alkoxy group, f is 1-10, g is 0 or 1, h is 1-50, i is 0-50, j is 0-50, k is 4-8; $C_6Q_4$ is unsubstituted or substituted; Q is independently selected from H, $C_{1-10}$ alkyl, $C_{1-10}$ alkenyl, and mixtures thereof;

D is $R^4_2SiO_{2/2}$ wherein $R^4$ is independently H or an alkyl group;

D' is $R^5_2SiO_{2/2}$ wherein $R^5$ is independently H, an alkyl group, or $(CH_2)_f—(C_6Q_4)_q O—(C_2H_4O)_h—(C_3H_6O)_i—(C_kH_{2k}O)_j—R^3$, provided that at least one $R^5$ is $(CH_2)_f(C_6Q_4)_qO—(C_2H_4O)_h—(C_3H_6O)_i(C_kH_{2k})_j—R^3$, wherein $R^3$ is independently H, an alkyl group or an alkoxy group, f is 1-10, g is 0 or 1, h is 1-50, i is 0-50, j is 0-50, k is 4-8; $C_6Q_4$ is unsubstituted or substituted; Q is independently selected from H, $C_{1-10}$ alkyl, $C_{1-10}$ alkenyl, and mixtures thereof; and D'' is $R^6_2SiO_{2/2}$ wherein $R^6$ is independently H, an alkyl group or $(CH_2)_l(C_6Q_4)_m(A)_n$-$[(L)_o$-$(A')_p$-$]_q$-$(L')_rZ(G)_s$, wherein l is 1-10; m is 0 or 1; n is 0-5; o is 0-3; p is 0 or 1; q is 0-10; r is 0-3; s is 0-3; $C_6Q_4$ is unsubstituted or substituted; Q is independently selected from H, $C_{1-10}$ alkyl, $C_{1-10}$ alkenyl, and mixtures thereof; A and A' are each independently a linking moiety representing an ester, a keto, an ether, a thio, an amido, an amino, a $C_{1-4}$ fluoroalkyl, a $C_{1-4}$ fluoroalkenyl, a branched or straight chained polyalkylene oxide, a phosphate, a sulfonyl, a sulfate, an ammonium, and mixtures thereof; L and L' are each independently a $C_{1-30}$ straight chained or branched alkyl or alkenyl or an aryl which is unsubstituted or substituted; Z is a hydrogen, carboxylic acid, a hydroxy, a phosphato, a phosphate ester, a sulfonyl, a sulfonate, a sulfate, a branched or straight-chained polyalkylene oxide, a nitryl, a glyceryl, an aryl unsubstituted or substituted with a $C_{1-30}$ alkyl or alkenyl, a carbohydrate unsubstituted or substituted with a $C_{1-10}$ alkyl or alkenyl or an ammonium; G is an anion or cation such as $H^+$, $Na^+$, $Li^+$, $K^+$, $NH_4^+$, $Ca^{+2}$, $Mg^{+2}$, $Cl^-$, $Br^-$, $I^-$, mesylate or tosylate.

Examples of the types of siloxane-based surfactants described herein above may be found in EP-1,043,443A1, EP-1,041,189 and WO-01/34,706 (all to GE Silicones) and U.S. Pat. No. 5,676,705, U.S. Pat. No. 5,683,977, U.S. Pat. No. 5,683,473, and EP-1,092,803A1 (all assigned to Lever Brothers).

The polyether siloxane surfactants typically have a weight average molecular weight from 500 to 20,000 daltons. Such materials, derived from poly(dimethylsiloxane), are well known in the art. In the present invention, not all such siloxane-based surfactants are suitable, because they do not provide improved cleaning of soils compared to the level of cleaning provided by the lipophilic fluid itself.

Nonlimiting commercially available examples of suitable siloxane-based surfactants are TSF 4446 (ex. General Electric Silicones), XS69-B5476 (ex. General Electric Silicones); Jenamine HSX (ex. DelCon) and Y12147 (ex. OSi Specialties).

Another class of materials suitable for use as the auxiliary surfactant component is organic in nature. Preferred materials are organosulfosuccinate surfactants, with carbon chains of from about 6 to about 20 carbon atoms. Most preferred are organosulfosuccinates containing dialkly chains, each with carbon chains of from about 6 to about 20 carbon atoms. Also preferred are chains containing aryl or alkyl aryl, substituted or unsubstituted, branched or linear, saturated or unsaturated groups. Nonlimiting commercially available examples of suitable organosulfosuccinate surfactants are available under the trade names of Aerosol OT and Aerosol TR-70 (ex. Cytec).

When present, the auxiliary surfactant may, though not required to, comprise from about 0.01% to about 50%, preferably from about 1% to about 40%, and more preferably from about 2% to about 30%, by weight of the wash liquor. The auxiliary surfactant, when present in the fabric care composition, may comprise from about 1% to about 99%, preferably from about 2% to about 80%, and more preferably from about 5% to about 60%, by weight of the composition.

Cleaning Method And Apparatus

The cleaning methods employing the compositions of the present invention include conventional immersive cleaning methods as well as the non-immersive cleaning methods disclosed in U.S. patent application Nos. 2002/0133886A1 and 2002/0133885A1.

The dry cleaning system and/or apparatus comprises a fabric article treating vessel, a dry cleaning solvent reservoir, and optionally, a sensor for monitoring the contaminant level in the dry cleaning solvent. When contaminants concentration exceeds some pre-determined value, it would indicate that the dry cleaning solvent has reached maximum contaminant holding tolerance and needs to be purified. Additionally, a solvent purification recovery unit may also be provided as an integral part of the system/apparatus. However, the solvent recovery unit may also be a stand-alone device, separate from the dry cleaning system/apparatus.

Any suitable fabric article treating vessel known to those of ordinary skill in the art can be used. The fabric article treating vessel receives and retains a fabric article to be treated during the operation of the cleaning system. In other words, the fabric article treating vessel retains the fabric article while the fabric article is being contacted by the dry cleaning solvent. Nonlimiting examples of suitable fabric article treating vessels include commercial cleaning machines, domestic, in-home, washing machines, and clothes drying machines.

The methods and systems of the present invention may be used in a service, such as a cleaning service, diaper service, uniform cleaning service, or commercial business, such as a laundromat, dry cleaner, linen service which is part of a hotel, restaurant, convention center, airport, cruise ship, port facility, casino, or may be used in the home.

The methods of the present invention may be performed in an apparatus that is a modified existing apparatus and is retrofitted in such a manner as to conduct the method of the present invention in addition to related methods.

The methods of the present invention may also be performed in an apparatus that is specifically built for conducting the present invention and related methods.

Further, the methods of the present invention may be added to another apparatus as part of a dry cleaning solvent processing system. This would include all the associated plumbing, such as connection to a chemical and water supply, and sewerage for waste wash fluids.

The methods of the present invention may also be performed in an apparatus capable of "dual mode" functions. A "dual mode" apparatus is one capable of both washing and drying fabrics within the same vessel (i.e., drum). These apparatuses are commercially available, particularly in Europe.

Additionally, the method of the present invention may also be performed in an apparatus capable of performing "bi-modal" cleaning functions. A "bi-modal" apparatus is one capable of performing both non-aqueous washing and aqueous washing in the same vessel, wherein the two washing modes can be performed in sequential washing cycles or in a combination washing cycle. Moreover, the bi-modal machine can also be capable of fully drying the clothes without having to transfer them to a separate machine. An apparatus suitable for use in the present invention will typically contain some type of control systems, including electrical systems, such as "smart control systems", as well as more traditional electromechanical systems. The control systems would enable the user to select the size of the fabric load to be cleaned, the type of soiling, the extent of the soiling, the time for the cleaning cycle. Alternatively, the control systems provide for pre-set cleaning and/or refreshing cycles, or for controlling the length of the cycle, based on any number of ascertainable parameters the user programmed into the apparatus. For example, when the collection rate of dry cleaning solvent reaches a steady rate, the apparatus could turn its self off after a fixed period of time, or initiate another cycle for the dry cleaning solvent.

In the case of electrical control systems, one option is to make the control device a so-called "smart device", which provides smart functions, such as self diagnostics; load type and cycle selection; Internet links, which allow the user to start the apparatus remotely, inform the user when the apparatus has cleaned a fabric article, or allow the supplier to remotely diagnose problems if the apparatus malfunctioned. Furthermore, if the system of the present invention is only a part of a cleaning system, the so called "smart system" could be communicating with the other cleaning devices which would be used to complete the remainder of the cleaning, such as a washing machine, and a dryer.

EXAMPLES

Example 1

Preparation of exemplary detersive surfactants are disclosed below:

(i) 1-[bis(2-hydroxyehtyl)amino]-3-[(2-ethylhexyl)oxy]-2-propanol

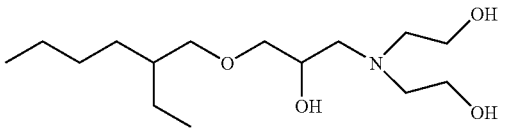

A three-necked, septum capped, 250 mL, round-bottom flask equipped with an addition funnel and containing a magnetic stirring bar is flushed with argon and charged with 2-ethylhexylglycidyl ether (66.53 g, 0.35 mol). Diethanolamine (40.89 g, 0.38 mol) is added during 10 min to the glycidyl ether, with stirring. The flask is placed in an oil bath and heated at a bath temperature of 75-80° C. overnight. The reaction is cooled and checked by $^{1}H$ NMR to ensure the complete consumption of the glycidyl ether. A colorless viscous liquid is obtained.

(ii) Butoxylated 2-hydropropyldiethanolamine

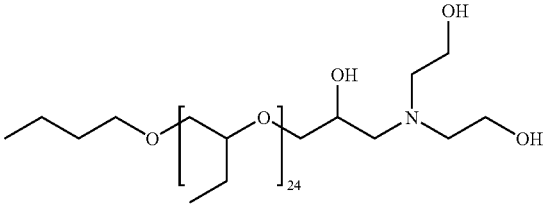

Sodium butoxide/1-butanol: Add to a 50 mL, single necked, round-bottom flask equipped with a magnetic stirrer and argon inlet, 1-butanol (6.44 g, 87.0 mmol) and sodium metal spheres (0.20 g, 8.7 mmol). Stir mixture under argon until all sodium reacts with alcohol to obtain clear, colorless liquid.

Butoxylated-1-butanol: To each of four stainless steel, 7.5 mL, high-pressure reactors is added the 1-butanol-sodium hydroxide mixture (0.17 g, 2.30 mmol) and 1,2-epoxybutane (3.97 g, 55 mmol). Seal reactors and heat them at 130° C. for 16 hours (one reactor contained and internal thermocouple). Combine the contents of all 4 reactors and Kugelrohr at 75° C. at 1 mm Hg to remove any residual volatiles. A light yellow liquid is obtained.

Butoxylated-1-butanol glycidyl ether: Add to a 50 mL, single neck, round-bottom flask equipped with a magnetic stirring bar and argon inlet, epichlorohydrin (2.20 g, 24.0 mmol), sodium hydroxide 50% wt. Solution (3.00 g, 38.0 mmol) and 0.1 g of tetrabutylammonium hydrogen sulfate. Stir mixture well, add butoxylated-1-butanol (7.00 g, 4.40 mmol) and stir reaction overnight under argon. Add 30 mL of diethyl ether to reaction, mix well, let stand to separate and decant off ether layer. Repeat this procedure three times. Combine ether extractions and wash three times with 20-30 mL of deionized water each time until pH neutral. Dry ether phase over anhydrous magnesium sulfate and filter. Remove solvent by rotary evaporation and residual volatiles by Kugelrohr at 50° C. at 1 mm Hg.

Butoxylated 2-hydroxypropyldiethanolamine: Add to a 50 mL, single neck, round-bottom flask equipped with a magnetic stirring bar and condenser with argon inlet, diethanolamine (0.56 g, 5.3 mmol) and 10 g of 2-propanol. With mixing, add a solution butoxylated-l-butanol glycidyl ether (5.00 g, 2.69 mmol) in 7 g of 2-propanol. Stir reaction mixture well under argon and heat it at 80° C. overnight. Cool reaction mixture to room temperature and remove solvent by rotary evaporation. Dissolve yellow residue with 50 mL of hexanes and wash organic solution with 10% wt. sodium carbonate solution. Separate hexane layer, remove solvent and any other residual volatiles by rotary evaporation followed by Kugelrohr. A yellow liquid is obtained.

(iii) Mono- & Di-Oleyl Phosphate Ester

Phosphorus pentoxide (14.15 g, 100 mmol) is placed into a three-necked round-bottom flask equipped with a mechanical stirrer, thermometer, and addition funnel. Heat the round-bottom flask and its contents using a silicone oil bath while keeping the reaction under argon, to 70° C. with stirring. Add very slowly the oleyl alcohol (67.57 g, 250 mmol) while keeping the temperature below 75° C. Upon final addition of alcohol, heat oil bath to 90° C. and exchange a condenser for the addition funnel. After 20 hours of heating add 10 g of deionized water to the reaction. Increase stirring rate and heat for an additional 3 hours. Remove heat source, cool reaction mixture and dilute it with 150 mL of hexanes. Wash hexane mixture twice with deionized water. Separate hexane layer and remove solvent in the rotary evaporator, Kugelrohr at 80° C. for 1 hour.

(iv) C9/11EO8-pyran

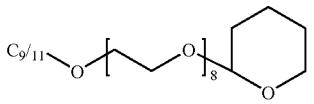

Neodol® 91-8, which is a $C_{12}$-$C_{18}$ alkyl ethoxylates, available from Shell chemicals (50.00 g, 97.9 mmol) is placed into a 1000 mL three-necked round-bottom flask, fitted with a heating mantle, magnetic stirrer and argon inlet and dried under vacuum at 75° C. After cooling to ambient and releasing the vacuum with argon, 3,4-dihydrop-2H-pyran (24.71 g, 293.7 mmol), methylene chloride (500 mL) and pyridinium p-toluenesulfonate (2.46 g, 9.8 mmol) are added. The mixture is stirred overnight at ambient, diluted to twice the volume with diethyl ether and washed twice with half-saturated brine. The organic layer is dried with magnesium sulfate, concentrated by rotary evaporation and further dried under vacuum to yield 57.81 g of a nearly colorless liquid.

(v) N,N'-Di-2,5-dimethylhexyl DL-malamide

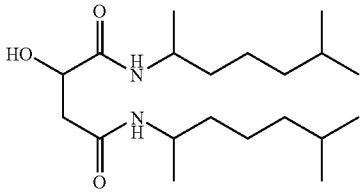

Diethyl DL-malate (13.78 g, 71.0 mmol), methanol (80 mL), and 2,5-dimethylhexylamine (18.54 g, 142.0 mmol) are added to a round-bottomed flask. The clear light yellow solution is gently refluxed at 70° C. overnight. The methanol and ethanol are removed in vacuo to yield a clear, yellow liquid.

Example 2

A control fabric care composition containing a nonionic surfactant and one or more cleaning adjuncts is prepared by mixing the components as following:

| Components | Concentration (wt %) |
|---|---|
| Surfactant - Tergitol ® 15S-3* | 50 |
| Propylene glycol | 25 |
| TSF-4446** | 10 |
| Water | 15 |
| Total | 100 |

*a secondary alcohol nonionic surfactant from Dow

**a silicone copolyol from General Electric

This detergent composition is diluted with D5/0.5% water to 1 wt % concentration in the resulting wash liquor (referred to as "Example 2"). The stain removal or fabric cleaning capability of Example 2 is tested according to ASTM D4265-98 using cotton swatches and artificial stains. Example 3 shows an improved stain removal of grass, clay and wine, compared to the neat solvent (D5/0.5% water) containing no cleaning adjuncts.

Example 3

A detergent composition of the present invention containing a branched alkanolamine based surfactant and one or more cleaning adjuncts is prepared by mixing the components as following:

| Components | Concentration (wt %) |
|---|---|
| 1-[bis(2-hydroxyehtyl)amino]-3-[(2-ethylhexyl)oxy]-2-propanol | 50 |
| Propylene glycol | 25 |
| TSF-4446* | 10 |
| Water | 15 |
| Total | 100 |

*a silicone copolyol from General Electric

This detergent composition is diluted with D5/0.5% water to 1 wt % concentration in the resulting wash liquor (referred to as "Example 3"). The stain removal or fabric cleaning capability of Example 3 is tested according to ASTM D4265-98 using cotton swatches and artificial stains. Example 3 shows an improved blood stain removal, as compared to Example 2.

Example 4

A detergent composition is prepared according to Example 2, except that the surfactant therein is replaced with an alkanolamine based surfactant (shown below). This composition is diluted with D5/0.5% water to 1 wt % concentration in the resulting wash liquor (Example 4). The stain removal or fabric cleaning capability of the composition is tested according to ASTM D4265-98 using cotton swatches and artificial stains. Example 4 shows poor grass stain removal capability, compared to Examples 2 and 3.

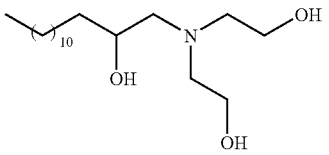

Example 3 comprises a branched alkanolamine surfactant, which is a liquid and soluble in D5. Here, Compound 19 is a linear alkanolamine surfactant, which is a solid with low solubility in D5. , Without being bound by theory, it is believed that surfactants that are soluble in the lipophilic fluid provide better cleaning or stain removal capability. Moreover, branching reduces the crystallinity of the surfactant compound and makes it more soluble in lipophilic fluids.

Example 5

A detergent composition is prepared according to Example 2, except that the surfactant therein is replaced with another alkanolamine based surfactant (shown below). This composition is diluted with D5/0.5% water to 1 wt % concentration in the resulting wash liquor (Example 5). The stain removal or fabric cleaning capability of the composition is tested according to ASTM D4265-98 using cotton swatches and artificial stains. Example 5 shows an improved grass and clay stain removal, compared to Example 2.

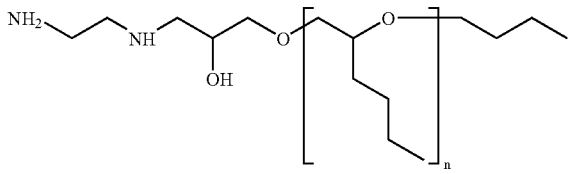

Example 6

A detergent composition is prepared according to Example 2, except that the surfactant therein is replaced with the surfactant Bis(2-ethylhexyl) hydrogen-phosphate (shown below). This composition is diluted with D5/0.5% water to 1 wt % concentration in the resulting wash liquor (Example 6). The stain removal or fabric cleaning capability of the composition is tested according to ASTM D4265-98 using cotton swatches and artificial stains. Example 6 shows an improved stain removal of blood, grass and clay, compared to Example 2.

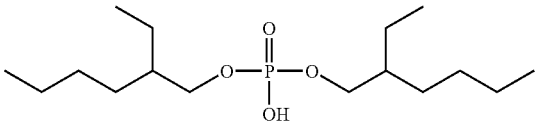

Example 7

A detergent composition is prepared according to Example 2, except that the surfactant therein is replaced with the surfactant Gemini diols Evirogem® AE02 (available form Air Products). This composition is diluted with D5/0.5% water to 1 wt % concentration in the resulting wash liquor (Example 7). The stain removal or fabric cleaning capability of the composition is tested according to ASTM D4265-98 using cotton swatches and artificial stains. Example 7 shows an improved clay stain removal, compared to Example 2.

Example 8

A detergent composition is prepared according to Example 2, except that the surfactant therein is replaced with a capped nonionic surfactant (shown below). This composition is diluted with D5/0.5% water to 1 wt % concentration in the resulting wash liquor (Example 8). The stain removal or fabric cleaning capability of the composition is tested according to ASTM D4265-98 using cotton and polyester swatches and artificial stains. Example 8 shows an improved stain removal of grass and wine, compared to Example 2.

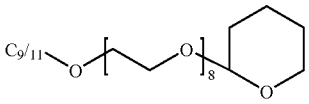

Example 9

A detergent composition is prepared according to Example 2, except that the surfactant therein is replaced with a surfactant, butoxylated alkanolamine (shown below). This composition is diluted with D5/0.5% water to 1 wt % concentration in the resulting wash liquor (Example 9). The stain removal or fabric cleaning capability of the composition is tested according to ASTM D4265-98 using cotton swatches and artificial stains. Example 9 shows an improved stain removal of grass and clay, compared to Example 2.

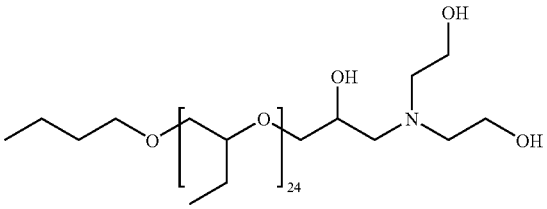

Example 10

A detergent composition is prepared according to Example 2, except that the surfactant therein is replaced with a surfactant, alkylphosphoric acid, alkylamine salt OS29253K (available from Lubrizol). This composition is diluted with D5/0.5% water to 1 wt % concentration in the resulting wash liquor (Example 10). The stain removal or fabric cleaning capability of the composition is tested according to ASTM D4265-98 using cotton swatches and artificial stains. Example 10 shows an improved stain removal of make-up, grass and clay, compared to Example 2.

Example 11

A detergent composition is prepared according to Example 2, except that the surfactant therein is replaced with a surfactant, a branched diamido alcohol (shown below). This composition is diluted with D5/0.5% water to 1 wt % concentration in the resulting wash liquor (Example 11). The stain removal or fabric cleaning capability of the composition is tested according to ASTM D4265-98 using cotton swatches and artificial stains. Example 11 shows an improved grass stain removal, compared to Example 2.

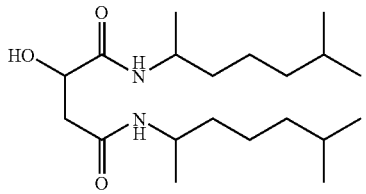

Example 12

A detergent composition is prepared according to Example 2, except that the surfactant therein is replaced with a surfactant, dodecanoic acid bis-(2-hydroxy-ethyl)-amide. This composition is diluted with D5/0.5% water to 1 wt % concentration in the resulting wash liquor (Example 12). The stain removal or fabric cleaning capability of the composition is tested according to ASTM D4265-98 using cotton swatches and artificial stains. Example 12 shows an improved blood stain removal, compared to Example 2.

All documents cited are, in relevant part, incorporated herein by reference; the citation of any document is not to be construed as an admission that it is prior art with respect to the present invention.

While particular embodiments of the present invention have been illustrated and described, it would be apparent to those skilled in the art that various other changes and modifications can be made without departing from the spirit and scope of the invention. It is therefore intended to cover in the appended claims all such changes and modifications that are within the scope of this invention.

What is claimed is:

1. A composition capable of removing soils from a fabric article comprising:

(a) a lipophilic fluid comprising decamethylcyclopentasiloxane;

(b) a detersive surfactant selected from the group consisting of 1-[bis(2-hydroxyethyl)amino]-3-[(2-ethylhexyl)oxy]-2-propanol, butoxylated 2-hydroxypropyldiethanolamine, mono- and di-oleyl phosohate ester, C9/11EO8-pyran, and N,N'-di-2,5-dimethylhexyl DL-malamide;

(c) a polar solvent; and (d) from about 0.01% to about 20% by weight of a polyether siloxane auxiliary surfactant.

2. The composition according to claim 1 wherein the lipophilic fluid comprises from about 70% to about 99.99% by weight of the composition.

3. The composition according to claim 1 wherein the detersive surfactant component comprises from about 0.01% to about 50% by weight of the composition.

4. The composition according to claim 1 wherein the polar solvent comprises water.

5. The composition according to claim 1 wherein water comprises from about 0.01% to about 50% by weight of the composition.

6. The composition according to claim 1 wherein the composition further comprises a cleaning adjunct selected from the group consisting of:

builders, emulsifying agents, enzymes, bleach activators, bleach catalysts, bleach boosters, bleaches, alkalinity sources, antibacterial agent, colorants, perfumes, lime soap dispersants, odor control agents, odor neutralizers, polymeric dye transfer inhibiting agents, crystal growth inhibitors, photo bleaches, heavy metal ion sequestrants, anti-tarnishing agents, anti-microbial agents, anti-oxidants, anti-redeposition agents, soil release polymers, electrolytes, pH modifiers, thickeners, abrasives, divalent ions, metal ion salts, enzyme stabilizers, corrosion inhibitors, diamines and polyamines and their their alkoxylates, suds stabilizing polymers, solvents, process aids, fabric softening agents or actives, sizing agents, optical brighteners, hydrotropes and mixtures thereof.

* * * * *

UNITED STATES PATENT AND TRADEMARK OFFICE

CERTIFICATE OF CORRECTION

PATENT NO. : 7,318,843 B2
APPLICATION NO. : 10/876180
DATED : January 15, 2008
INVENTOR(S) : Sivik et al.

It is certified that error appears in the above-identified patent and that said Letters Patent is hereby corrected as shown below:

Column 2

Line 36, delete "$(C_6Q_4)_q$" and insert -- $(C_6Q_4)_g$ --.

Line 38, delete "$(C_6Q_4)_q$" and insert -- $(C_6Q_4)_g$ --.

Line 45, insert -- or substituted -- after the word unsubstituted.

Column 7

Line 49, delete "$(C_6Q_4)_q$" and insert -- $(C_6Q_4)_g$ --.

Line 51, delete "$(C_6Q_4)_q$" and insert -- $(C_6Q_4)_g$ --.

Column 19

Line 18, delete "$(C_6Q_4)_q$" and insert -- $(C_6Q_4)_g$ --.

Line 20, delete "$(C_6Q_4)_q$" and insert -- $(C_6Q_4)_g$ --.

Line 29, delete "$(C_6Q_4)_q$" and insert -- $(C_6Q_4)_g$ --.

Line 31, delete "$(C_6Q_4)_q$" and insert -- $(C_6Q_4)_g$ --.

Signed and Sealed this

Twenty-seventh Day of May, 2008

JON W. DUDAS
*Director of the United States Patent and Trademark Office*